US007780373B2

(12) United States Patent
Ustyugov

(10) Patent No.: US 7,780,373 B2
(45) Date of Patent: Aug. 24, 2010

(54) METHOD AND APPARATUS FOR MAKING COMPACTED SNOW PAVEMENTS

(76) Inventor: Dmitry Nikolaevich Ustyugov, Nadym, ul Naberezhnaya, d.43, kv.34, 629735 Yanao (RU)

( * ) Notice: Subject to any disclaimer, the term of this patent is extended or adjusted under 35 U.S.C. 154(b) by 751 days.

(21) Appl. No.: 11/302,751

(22) Filed: Dec. 13, 2005

(65) Prior Publication Data

US 2006/0133898 A1 Jun. 22, 2006

(30) Foreign Application Priority Data

Dec. 21, 2004 (RU) ..... 2004137461

(51) Int. Cl.
*E01C 19/00* (2006.01)

(52) U.S. Cl. ..... 404/75; 404/17; 404/71; 404/77; 404/83

(58) Field of Classification Search ..... 404/17, 404/71, 75, 77, 79, 82, 83–84.2, 90–92, 96, 404/101, 102, 105, 108, 113–120
See application file for complete search history.

(56) References Cited

U.S. PATENT DOCUMENTS 1,837,030 A * 12/1931 Elze ..... 126/271.2 B
2,197,307 A * 4/1940 Jenkins ..... 37/277
2,588,039 A * 3/1952 Pepi ..... 37/228
2,602,443 A * 7/1952 Leary ..... 126/343.5 R
2,605,760 A * 8/1952 Cayas ..... 126/343.5 R
2,987,741 A * 6/1961 Feldman et al. ..... 15/4
3,013,552 A * 12/1961 West ..... 126/271.2 A
3,221,417 A * 12/1965 Mellinger ..... 34/528
3,291,118 A * 12/1966 Wilson ..... 126/271.2 R
3,371,586 A * 3/1968 Nikolacv et al. ..... 404/91
3,986,783 A * 10/1976 Rowley et al. ..... 404/95
4,071,966 A * 2/1978 Cohen ..... 37/228
4,172,679 A * 10/1979 Wirtgen ..... 404/90
4,226,034 A * 10/1980 Benjamin et al. ..... 37/229

(Continued)

FOREIGN PATENT DOCUMENTS

CA 2357763 * 12/2001

(Continued)

OTHER PUBLICATIONS

Gray, D.M. and Male, D.H. "*Handbook of Snow*"; Leningrad, Hydrometeoizdat Publishing House, 1986; pp. 519-524.

*Primary Examiner*—Raymond W Addie
(74) *Attorney, Agent, or Firm*—Fish & Richardson P.C.

(57) ABSTRACT

The invention relates to making compacted snow pavements and can be used in apparatuses for compacting snow mass. The inventive apparatus for making compacted snow pavements comprises a front sliding support 1, a rear sliding support 2, a power generator 7, a heat unit 5 having a working zone and provided with a means for supplying heat to snow mass through the working zone, and a means 11 for dynamic compaction. The heat unit 5 is made in the form of at least one separate heat module. The means for supplying heat is arranged so as to be capable of adjusting intensity of the heat flow and fixing the direction in which it is supplied to the working zone. The method of making a compacted snow pavement consists in using the inventive apparatus. The technical result attainable thereby resides in providing a pavement that possesses high load-bearing capacity, wear resistance as well as improved gripping characteristics.

68 Claims, 3 Drawing Sheets

U.S. PATENT DOCUMENTS

| | | | | | |
|---|---|---|---|---|---|
| 4,440,520 | A | * | 4/1984 | Fisher | 404/72 |
| 4,544,304 | A | * | 10/1985 | Fisher | 404/17 |
| 4,571,117 | A | * | 2/1986 | Johnson et al. | 404/77 |
| 4,601,605 | A | * | 7/1986 | Damp et al. | 404/95 |
| 4,676,224 | A | * | 6/1987 | Ohno | 126/343.5 R |
| 4,781,491 | A | * | 11/1988 | Chiba et al. | 404/95 |
| 4,918,844 | A | * | 4/1990 | Marsh | 37/197 |
| 4,969,772 | A | * | 11/1990 | Chiba et al. | 404/77 |
| 5,016,366 | A | * | 5/1991 | Watson | 37/220 |
| 5,174,751 | A | * | 12/1992 | Chapman et al. | 432/227 |
| 5,188,481 | A | * | 2/1993 | O'Brien | 404/95 |
| 5,235,762 | A | * | 8/1993 | Brady | 37/228 |
| 5,588,231 | A | * | 12/1996 | Mavrianos | 37/227 |
| 5,653,552 | A | * | 8/1997 | Wiley et al. | 404/77 |
| 5,787,613 | A | * | 8/1998 | Derome | 37/228 |
| 5,791,814 | A | * | 8/1998 | Wiley | 404/91 |
| 5,956,872 | A | * | 9/1999 | Mavrianos | 37/228 |
| 6,305,105 | B1 | * | 10/2001 | Lowman | 37/228 |
| 6,904,708 | B2 | * | 6/2005 | Rogers | 37/228 |
| 2002/0044829 | A1 | * | 4/2002 | Rickards | 404/75 |
| 2003/0175077 | A1 | * | 9/2003 | Godbersen et al. | 404/84.2 |

FOREIGN PATENT DOCUMENTS

| | | |
|---|---|---|
| RU | 2192515 | 11/2002 |
| SU | 202984 | 9/1967 |
| SU | 255330 | 10/1969 |
| SU | 277818 | 8/1970 |
| SU | 446581 | 10/1974 |
| SU | 604896 | 4/1978 |
| SU | 734334 | 5/1980 |
| SU | 771242 | 10/1980 |
| SU | 850791 | 7/1981 |
| SU | 1350234 | 11/1987 |
| SU | 1622497 | 1/1991 |

* cited by examiner

METHOD AND APPARATUS FOR MAKING COMPACTED SNOW PAVEMENTS

SPECIFICATION

The invention relates to the field of road construction and, more particularly, to a method of and an apparatus for making compacted snow pavements and can be used in vehicles for compacting snow mass in flow-line construction of snow-and-ice roads in northern territories.

A snow compacting vehicle is known in prior art to comprise a housing coated with a heat-insulating material, which has the bottom thereof provided with a cavity connected by flexible hoses to the exhaust pipe of the tractor's engine (see, for instance, in the specification: USSR Inventor's Certificate No. 446581, Cl. E01H 4/00, publ. 1974).

However, such vehicle is low efficient because its compacting working member acts only once per pass of the unit, thus failing to meet the requirements of highly productive and high-quality erection of snow-and-ice roads.

Also, a snow-compacting vehicle is known in prior art to comprise two sections, each of which is made in the form of a frame, whereto skies are attached, the sections being connected to one another by means of a pivot (see, for instance, in the specification: German Patent No. DE 2947122).

Such vehicle is deficient in that the compacting working members cannot contact independently the surface being compacted, since they are interconnected with each other in a horizontal plane—a factor which reduced efficiency of the compacting process.

The closest to the claimed invention is an apparatus comprising a sliding support, a frame whereon a power generator and a pumping station are mounted, an operator's cab, a heat unit having a working zone and provided with a means for supplying heat to snow mass through the working zone, and a means for dynamic compaction (see, for instance, in the reference-book: Snow, edited by D. M. Grey and D. H. Mail, Leningrad; Hydrometeoizdat Publishing House, 1986, pp. 519-525).

A method is also known from the same publication to be used for making a compacted snow pavement, the method comprising the steps of heating snow mass in a heat unit until the mass reaches a moistened condition, and compacting the moistened snow mass by means of a system for dynamic compaction.

However, such method and apparatus for making compacted snow pavements fail to show high productivity and they do not ensure sufficient density and uniformity of the pavement throughout thickness and width thereof.

It is an object of the claimed invention to provide such an apparatus for making a compacted snow pavement, which allows to improve substantially strength and wear resistance of the resulting pavement due to ensuring uniform density of the pavement both throughout the width of the pavement and throughout the thickness thereof, make its use more harmless for the environment as well as to improve grip of the pavement by adding thereto an abrasive material, including also adsorbents for combustible and lubricating materials (CLM).

The object thus aimed at is accomplished owing to that in an apparatus for making compacted snow pavements, the apparatus comprising sliding supports, a power generator, a heat unit having a working zone and provided with a means for supplying heat to snow mass through the working zone, and a means for dynamic compaction, the heat unit is made in the form of at least one separate heat module, the means for supplying heat being made in the form of at least two nozzles aimed at the working zone and mounted so that the direction of heat flow can be changed and they can be fixed in a predetermined position by means of a fixing mechanism for mounting each nozzle relative to a longitudinal axis of the apparatus and/or its vertical axis perpendicular thereto rotatably in vertical and horizontal planes.

The apparatus can further comprise a means for static compaction that is disposed in front of the means for dynamic compaction in the direction of the apparatus travel.

Besides, the means for supplying heat can be made so as to be capable of varying intensity of supplying the heat flow to the working zone.

Preferably, the heat module defining the working zone comprises a heat-insulation casing that has side surface(s) and upper surface.

Besides, at least the casing surface adjacent to the surface being treated can be made so that it is open.

The nozzles can be pivotally mounted so that they face each other in the vicinity of and/or on the side surfaces of the casing and are arranged at an angle of 30° to 150° relative to the longitudinal axis of the apparatus and its vertical axis that is perpendicular thereto.

Preferably, the nozzles are fixed in a predetermined position by means of a fixing mechanism made in the form of a gimbal or ball suspension.

The nozzles of the heat module can comprise catalytic and/or multiple-zone dissectors for effecting uniform heating of snow mass.

Besides, the nozzles can be made in the form of burners.

The heat module can further comprise a protective heat screen disposed within the lower portion of the heat module to protect the upper vegetation layer from direct exposure to heat when operating where the snow layers are of small thickness, and also a means for ripping and mixing the snow mass.

Besides, the apparatus can comprise a frame, whose front part is pivotally connected to a front sliding support, and the rear part thereof is connected to a rear sliding support, wherein the power generator, pumping station, heat unit and also the systems for static and dynamic compaction are disposed on the frame.

Preferably, the apparatus comprises a mechanism for following up the relief of the surface being treated in order to follow continuously the natural and artificial irregularities of the relief and maintain a constant working gap between the surface being treated and the heat unit by way of adjusting the height to which the heat module(s) is (are) lifted up and/or lowered down, wherein the mechanism for following up the relief of the surface can be made in the form of a three-dimensional parallelepiped consisting of at least four rocking levers whose upper ends are attached to the frame of the apparatus, and the lower ends thereof, to the heat module by means of articulated joints.

In another embodiment, the apparatus for making compacted snow pavements comprises sliding supports, a power generator, a heat unit having a working zone and provided with a means for supplying heat to snow mass through the working zone, and a means for dynamic compaction, wherein the heat unit is made in the form of at least one separate module, the means for supplying heat being made in the form of at least one nozzle aimed at the working zone and mounted so that the direction of heat flow can be changed and the nozzle can be fixed in a predetermined position for mounting the nozzle relative to a vertical axis rotatably in longitudinal and transverse vertical planes.

The apparatus further comprises a means for static compaction that is disposed in front of the means for dynamic compaction in the direction of the apparatus travel.

Besides, the means for supplying heat can be made so as to be capable of varying intensity of supplying the heat flow to the working zone.

Preferably, the heat module comprises a heat-insulation casing that has side surface(s) and upper surface; at least the casing surface adjacent to the surface being treated is made so that it is open.

The nozzle can further be pivotally mounted in the vicinity of and/or on the upper surface of the casing.

Preferably, the nozzle can be arranged at an angle of 15° to 165° relative to the longitudinal axis and transverse axis of the apparatus.

Preferably, the nozzle can be fixed in a predetermined position by means of a fixing mechanism made in the form of a gimbal or ball suspension.

Besides, the nozzle of the heat module can comprise at least one catalytic and/or multiple-zone dissector for effecting uniform heating of snow mass.

Preferably, the nozzle is made in the form of a burner.

The heat module can further comprise a protective heat screen disposed within the lower portion of the heat module to protect the upper vegetation layer from direct exposure to heat when operating where the snow layers are of small thickness.

Besides, the heat module can further comprise a means for ripping and mixing the snow mass.

Preferably, the apparatus comprises a frame, whose front part is pivotally connected to a front sliding support, and the rear part thereof is connected to a rear sliding support, wherein the power generator, pumping station, heat unit and also the systems for static and dynamic compaction are disposed on the frame.

Besides, it can comprises a mechanism for following up the relief of the surface being treated in order to follow continuously the natural and artificial irregularities of the relief and maintain a constant working gap between the surface being treated and the heat unit by way of adjusting the height to which the heat module(s) is (are) lifted up and/or lowered down, wherein the mechanism for following up the relief of the surface can be made in the form of a three-dimensional parallelepiped consisting of at least four rocking levers whose upper ends are attached to the frame of the apparatus, and the lower ends thereof, to the heat module by means of articulated joints.

In a further embodiment, the apparatus for making compacted snow pavements comprises a frame, whereon mounted are sliding supports, a power generator, a pumping station, a system for dynamic compaction, and a heat unit having a working zone and provided with a means for supplying heat to snow mass through the working zone, wherein a system for static compaction is provided which comprises a means for adjusting the force applied to the surface being treated within the range of static loads of 0.5 to 40 t, the means for adjusting the force applied to the surface being treated is made in the form of a body/bodies disposed movably on the frame, whereas the system for dynamic compaction is made so as to be capable of adjusting the frequencies of dynamic influence within the range of 0.2 to 1000 Hz.

As the movable body, use can be made of at least one of the components of the apparatus, such as, for instance, the power generator, the pumping station and/or the heat unit, in order to vary the profile of static loads on the surface being treated.

The system for static compaction can comprise a hopper for abrasive material, such as, for instance, sand, granite aggregate or absorbent for combustible and lubricating materials, whereto ballast weights can be fastened.

The hopper for abrasive material can comprise a means for uniform distribution of abrasive material in various fractions over the pavement width for dosing thereof and introducing it in between the systems for static and dynamics compaction into the surface being treated.

Besides, the system for static compaction can include a rear sliding support.

Preferably, the force applied to the surface being treated is within the range of dynamic frequencies or 25 to 450 Hz.

Besides, the system for dynamic compaction can comprise a vibrating compactor made so as to be capable of forming a corrugated surface on the profile of the surface being treated.

The vibrating compactor can be made in the form of a vibrating plate and/or a vibrating roller.

Besides, the frame can be made so that it is tubular, and it can thus perform the function of a fuel tank for supplying fuel to the power units of the apparatus.

Preferably, the apparatus comprises an operator's cab.

The system for dynamic compaction can further be provided with a hydraulic and/or electrical drive.

Besides, the front support can be made in the form of pivotable skies or a pivotable platform for a semitrailer prime mover.

In still another embodiment, the apparatus for making compacted snow pavements comprises a front pivotable sliding support, a rear sliding support, a power generator, a heat unit having a working zone and provided with a means for supplying heat to snow mass through the working zone, and a means for dynamic compaction, wherein the heat unit is made in the form of at least one separate heat module, and the means for supplying heat is mounted so as to be capable of adjusting intensity of the heat flow while fixing the direction in which it is supplied to the working zone.

The apparatus can further comprise a means for static compaction that is disposed in front of the means for dynamic compaction in the direction of the apparatus travel.

The heat module can comprise a heat-insulation casing, which defines a working zone and can have side surface(s), an upper surface, and a lower surface that is adjacent to the surface being treated.

Preferably, at least the casing surface adjacent to the surface being treated is made so that it is open.

It is also preferable to make the means for supplying heat in the form of at least one nozzle pivotally mounted in the vicinity of the upper surface of the casing so that it can swing and its angular position can be fixed.

It is even more preferable to make the means for supplying heat in the form of at least one nozzle pivotally mounted in the vicinity of the side surface of the casing so that it can swing and its angular position can be fixed.

The means for supplying heat can be also made in the form of at least one pair of nozzles pivotally mounted so that they face one another in the vicinity of the side surface of the casing so that they can swing and their angular position can be fixed.

The apparatus further comprises a mechanism for following up the relief of the surface being treated in order to follow continuously the natural and artificial irregularities of the relief and maintain a constant working gap between the surface being treated and the heat unit by way of adjusting the height to which the heat module(s) is (are) lifted up and/or lowered down, wherein the following-up mechanism can be made in the form of a three-dimensional parallelepiped consisting of at least four rocking levers whose upper ends are attached to the frame of the apparatus, and the lower ends thereof, to the heat module by means of articulated joints.

The heat module can further comprise a means for ripping and mixing the snow mass.

Preferably, the one or each nozzle is mounted so that it can be fixed in a predetermined angular position by means of a fixing mechanism, the fixing mechanism being made in the form of a gimbal or ball suspension.

In still further embodiment, the apparatus for making compacted snow pavements comprises a frame, a front pivotable sliding support attached pivotally to the frame, and a rear sliding support attached to the frame, a power generator, a heat unit having a working zone and provided with a means for supplying heat to snow mass through the working zone, and a means for dynamic compaction, wherein a system for static compaction is provided that is disposed behind the means for dynamic compaction in the direction of the apparatus travel and comprises a means for adjusting the force applied to the surface being treated and made in the form of a body/bodies disposed movably on the frame.

Preferably, the apparatus comprises a mechanism for following up the relief of the surface being treated in order to follow continuously the natural and artificial irregularities of the relief and maintain a constant working gap between the surface being treated and the heat unit by way of adjusting the height to which the heat module(s) is (are) lifted up and/or lowered down, wherein the following-up mechanism can be made in the form of a three-dimensional parallelepiped consisting of at least four rocking levers whose upper ends are attached to the frame of the apparatus, and the lower ends thereof, to the heat module by means of articulated joints.

Preferably, as the movable body/bodies, use can be made of the hopper, the power generator, the heat unit and/or other components of the apparatus.

Another aspect of the invention consists in a method of making a compacted snow pavement, the method comprising the steps of heating snow mass in a heat unit until the mass reaches a moistened condition, and compacting the moistened snow mass by means of a compaction system, wherein during heating the snow mass in the heat unit, the exposure temperature is adjusted within the range of 110° C. to 1600° C. in inverse proportion to variations in the ambient temperature and in direct proportion to the travel speed of the apparatus by varying the directional angle and/or intensity of supplying the heat flow to the snow mass, and the moistened snow is compacted in two steps, in which:

- at the step of static compaction, the load applied to the snow mass thus treated is adjusted by varying the force on a rear support, whereupon
- dynamic vibrating compaction is effected so that the frequency of dynamic influence can be adjusted within the range of 0.2 to 1000 Hz.

It is also possible to effect simultaneously heating of the snow mass and mixing thereof until an essentially uniform mixture is obtained.

Preferably, at the step of static compaction, use is made of the load ranging from 0.5 to 40 t and, at the step of dynamic vibrating compaction, use is made of the frequency ranging from 25 to 450 Hz.

Besides, the dynamic vibrating compaction can be carried out so that a corrugated surface is simultaneously formed on the profile of the road.

Preferably, protective heat screens are mounted within the lower portions of the heat modules when operating where the snow layers are of small thickness.

After the step of static compaction, an abrasive material, including also an absorbent for combustible and lubricating materials, can be further applied uniformly to the statically compacted surface of the pavement.

Other advantages and particularities of the invention are set forth below when describing various embodiments thereof that are presented herein as non-limiting examples and illustrated in the accompanying drawings, in which.

Figure 1:
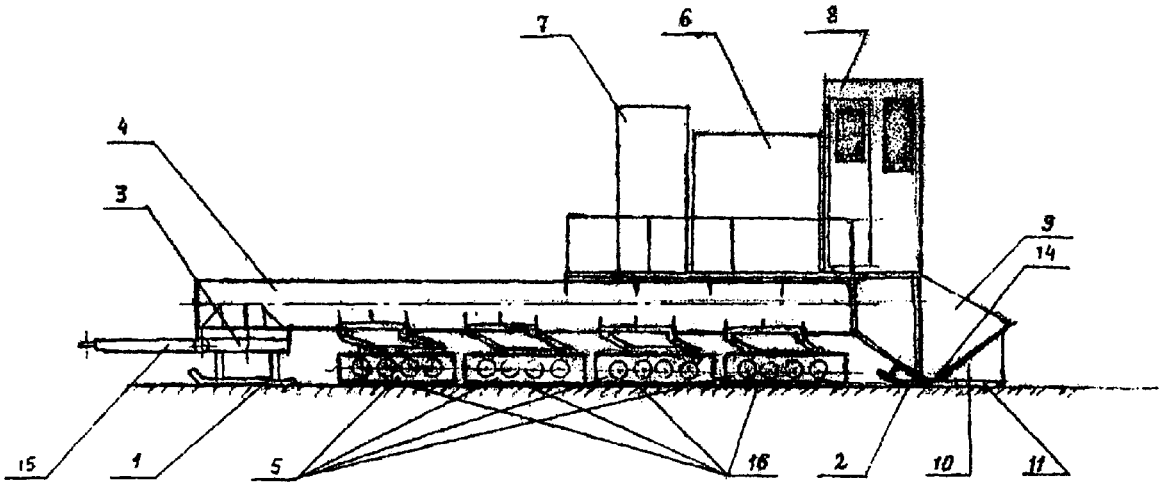
FIG. 1 is a side view of the apparatus according to the present invention.
Figure 2:
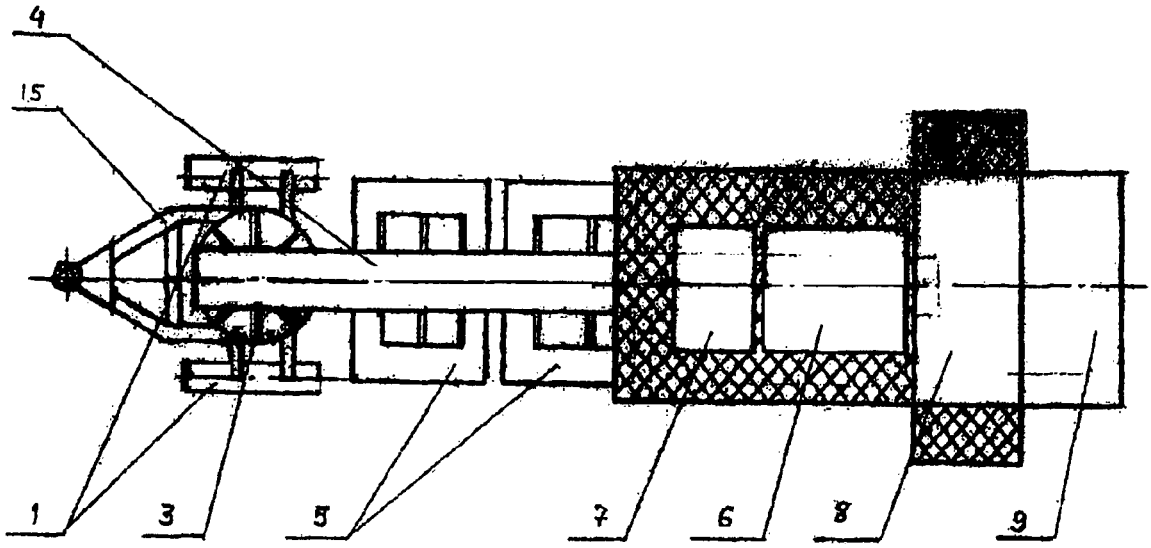
FIG. 2 is a plan view of the apparatus according to the present invention.
Figure 3:
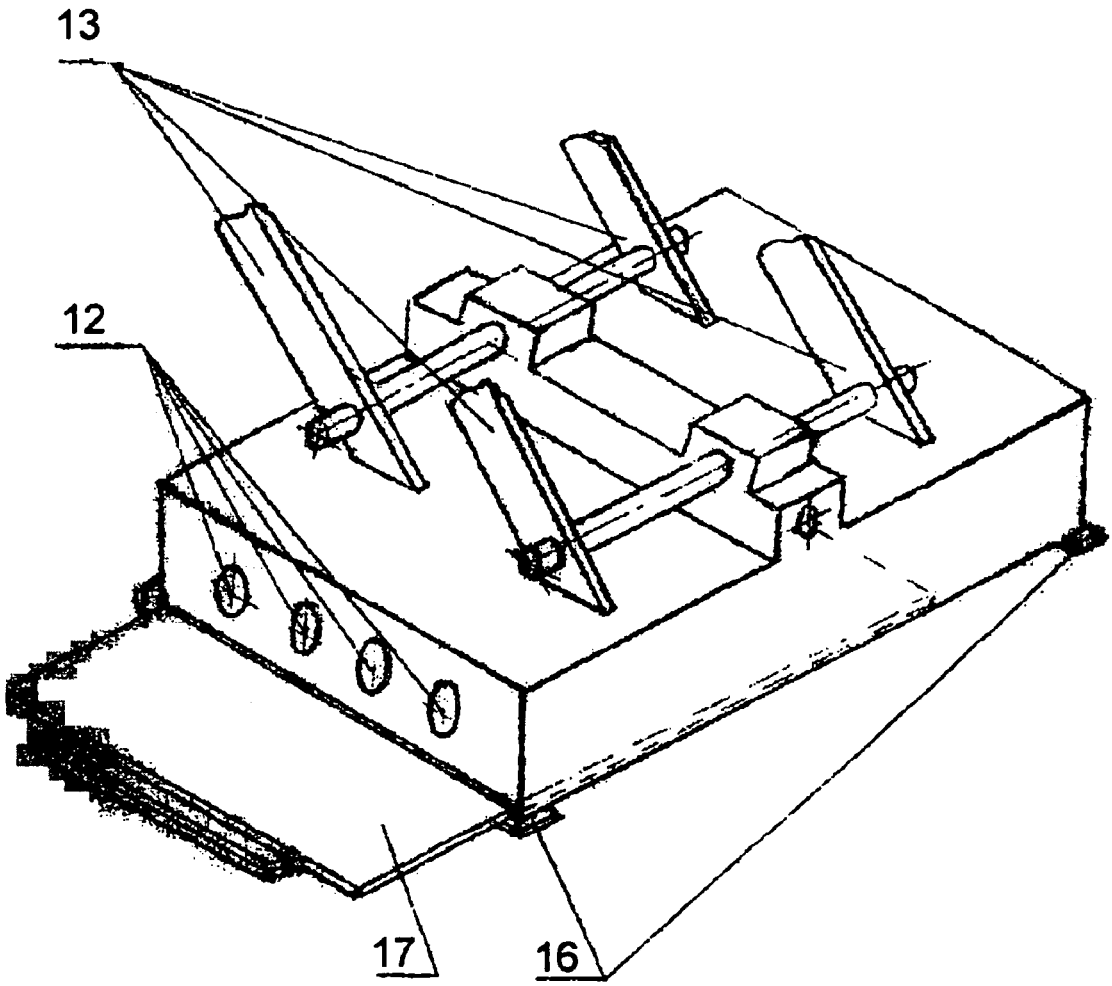
FIG. 3 shows a heat module.

As can be seen in FIGS. 1, 2 and 3, the apparatus for making a compacted snow pavement comprises at least two sliding supports 1 and 2 shaped up as skies and disposed within the front and rear parts of a frame 4 (the rear support is not seen in the plan view). The frame of the apparatus can be made in the form of a welded three-dimensional girder provided with fuel tanks mounted thereon or, else, so that it is tubular and performs the function of a fuel tank for feeding the power units of the apparatus, such as, for instance, a power generator and a heat unit. The front support 1 is pivotable relative to a longitudinal axis of the apparatus and connected to the tubular frame by a joint 3. The second support 2 can simultaneously be a part of a system of static compactor.

On the frame 4 are arranged a heat unit 5 with sliding supports 16 arranged along the sides thereof, a power generator 7 and a pumping station 6, e.g., a hydraulic one.

Besides, the apparatus can comprise an operator's cab 8 and a dynamic compaction system 10, comprising a vibrating compactor 11. The vibrating compactor made, for instance, in the form of a vibrating plate or a vibrating roller can be provided with corrugations for forming a corrugated surface on the profile of the surface being treated.

The heat unit 5 is made in the form of at least one separate module, see FIG. 3 (four modules are shown as an example in FIG. 1), in which at least one nozzle 12 is arranged for supplying heat energy to the snow mass, the nozzle being mounted so that it can be fixed in a predetermined position by means of a fixing mechanism, such as, for instance, a gimbal or ball suspension, which allows to vary the set angle of the nozzle within the range of −90° to +90° relative to vertical and horizontal axes. The heat modules can be arranged along the tubular frame so that it is possible to position them at variable height by means of a follow-up mechanism 13 which automatically follows the irregularities of the surface being treated, its longitudinal and transverse slopes. In order to obtain uniform snow mass in the process of heat treatment thereof, means for mixing and ripping, such as, for instance, blades, small ploughs, etc., can be arranged within the working zone of the heat unit 5.

The mechanism for following up the relief of the surface being treated can comprise a three-dimensional parallelepiped consisting of at least four rocking levers. The upper ends of the levers are attached to the frame of the apparatus by means of articulated joints, and the lower ends of the levers are attached also by means of articulated joints to the frame of the heat module which frame has a longitudinal rocking axis.

The system for static compaction comprises a means for adjusting the static force applied to the surface being treated, which means is made in the form of a body/bodies disposed movably on the frame. As such body that is movable along the frame, use can be made of at least one of the components of the apparatus, such as, for instance, the power generator, pumping station heat unit as well as additional weights, in order to vary the profile of static loads on the surface being treated. The system for static compaction can include also a hopper 9 with a dosing device 14 for applying abrasive material (including also an absorbent for combustible and lubricating materials—CLM) onto the pavement surface and is connected to the rear part of the frame 4.

The system for dynamic compaction comprises the at least one vibrating compactor 11 driven by the pumping station 6, e.g., a hydraulic one, and is disposed behind the system for static compaction in the direction of travel.

Preferably, the vibrating compactor is designed so as to increase the force applied to the surface being treated so that a corrugated surface is simultaneously formed on the profile of the pavement by the corrugations the compactor profile is provided with.

In the apparatus for making a compacted snow pavement, the hopper 9 is provided, in order to dispense abrasive material and an absorbent of CLM in fractions, for instance, of sand, granite aggregate or absorbent, having preferably the size of up to 100 mm, with a means (not shown in the drawing) for uniformly distributing thereof over the pavement width, which can be arranged below the hopper 9. The means for uniformly distributing the abrasive material over the pavement is driven by the motive power of the vehicle from a driving wheel (not shown in the drawings).

The front support 1 can be connected to a prime mover (not shown in the drawings) by means of a rigid coupling 15 or is made as a pivotable platform for a semitrailer prime mover.

Protective heat screens 17 are further arranged to be disposed within the lower portion of the heat module to protect the upper vegetation layer against direct exposure to heat when operating where the snow layers are of small thickness.

The apparatus for making a compacted snow pavement for motor roads, which has been discussed herein above, operates as follows. When the operator switches the power generator 7, the heat module(s) and the pumping station 6 on, while the prime mover and the apparatus are moving across a virgin snow layer at a speed of 0.5 to 10 km/hour (depending on the condition of the snow layer and the ambient temperature), the snow mass thus moved forward by the sliding supports enters the heat unit 5. A desired temperature is maintained inside the module(s) of the heat unit(s) 5, depending on the ambient temperature. Besides, depending on the static load applied to the surface thus compacted, there are adjusted both the force (within the range of 0.5 to 40 t) and the frequency of the vibrating compactor within the range of 0.2 to 1000 Hz (preferably 25 Hz to 450 Hz), which are applied to the mixture thus treated which consists of moistened snow mass and abrasive material, including also an absorbent of CLM, which serves to absorb liquid hydrocarbons (diesel fuel, petrol, machine oil) which can be spilled on the pavement in use, and moistened snow mass. It should be pointed out that it is not advisable to use either frequencies of over 1000 Hz because this leads to a high power consumption, or frequencies below 25 Hz, since this leads to poor quality of the resulting pavement. It is practically impossible to use a load above 40 t because of limited tractive capacities of the vehicle, whereas good quality is also unattainable for the resulting roadway where the load is less than 0.5 t.

As an example of using the means for adjusting the force applied to the surface being treated so as to ensure a static load of 40 t, mention can be made of an apparatus having a dry weight of 24 t, wherein the fuel tank has a capacity of 7.8 to 11.5 $m^3$ (embodiments), this corresponding to 6.24-9.2 t by weight (the average density of hydrocarbon fuel for these calculations has been assumed with a weight coefficient equal to 0.8). The volume of the sand-spreading hopper is equal to 8 $m^3$, this corresponding to 14.08 to 16.32 t by weight (the average density of sand for these calculations has been assumed with a weight coefficient equal to 1.76-2.04 (for the regions of Extreme North)).

Taking into account the fact that the sand-spreading hopper is structurally arranged behind the rear support of the apparatus at a distance of approximately 1 m therefrom, and the apparatus is structurally designed so that, when it is filled up completely with fuel, its hopper is loaded, and all the units are in their rearmost positions in the direction of travel, the center of gravity thereof is on the aft limit, the static load thus applied will make up, with some approximation, the sum total of the above-mentioned weights, and it can be then supposed to approach the value equal to 50 t, thus overlapping substantially the above-mentioned limit of 40 t.

If we take the embodiment of the apparatus when the hydrocarbon fuel is filled into the tank to ⅕ of its full capacity, all the units are in their front end positions in the direction of travel, and the sand-spreading hopper is not loaded with sand, the center of gravity of the apparatus is then on the forward limit, this being correspondent to the calculated value of the load applied to the static unit, which is equal to 0.5 t by weight, this characterizing in turn the upper limit of the static range.

Under certain conditions, the apparatus can travel at a technological speed equal to as low as 0.5 km/hour, which corresponds also to 14 cm/sec. Such a condition is possible when it is technologically reasonable to ensure that the working surface of the dynamic compactor would pass only once over the appropriately prepared surface thus being treated. If we take the embodiment where a vibrating compactor is used which has the working surface in the contact zone=0.7 m, the frequency of dynamic influence cannot then exceed 0.2 Hz. Hence, the minimum frequency must be equal to 0.2 Hz.

Also an embodiment can be given to show how the dynamic range under discussion could have been implemented technically. The lower limit does not raise any doubts, insofar as it can be implemented in any way. But, the upper limit of the range, i.e. 1000 Hz, could have been realized, for instance, by using hydraulic unbalance rotor vibration exciters.

Corrugations are simultaneously made on the surface being thus treated in order to improve the grip of vehicle wheels with the surface of the road thus formed. The abrasive material is heated by exhaust gases of the power generator and by hot air leaving the last heat module.

Using of the apparatus allows to improve quality of compacting the pavement made of compacted snow, its load-bearing capacity as well as wear resistance and gripping characteristics thereof.

The invention claimed is:

1. An apparatus for making compacted snow pavements, the apparatus comprising:

a sliding support positioned perpendicularly to a direction of movement of the apparatus, a power generator, a heat unit having a working zone and provided with a means for supplying heat to snow mass through the working zone, and a means for dynamic compaction, wherein the heat unit is made in the form of at least one separate heat module, the means for supplying heat being made in the form of at least two nozzles aimed at the working zone and mounted so that the direction of heat flow can be changed and they can be fixed in a predetermined position by means of a fixing mechanism for mounting each nozzle relative to a longitudinal axis of the apparatus and/or its vertical axis perpendicular thereto rotatably in vertical and horizontal planes.

2. The apparatus according to claim 1, which comprises a means for static compaction that is disposed in front of the means for dynamic compaction in the direction of the apparatus travel.

3. The apparatus according to claim 1, wherein the means for supplying heat is made so as to be capable of varying intensity of supplying the heat flow to the working zone.

4. The apparatus according to claim 1, wherein the heat module comprises a heat-insulation casing defining the working zone.

5. The apparatus according to claim 4, wherein the casing has side surface(s) and upper surface.

6. The apparatus according to claim 4, wherein at least the casing surface adjacent to the surface being treated is made so that it is open.

7. The apparatus according to claim 1, wherein the nozzles are pivotally mounted so that they face each other in the vicinity of and/or on the side surfaces of the casing.

8. The apparatus according to claim 1, wherein the nozzles can be arranged at an angle of 30° to 150° relative to the longitudinal axis of the apparatus and its vertical axis that is perpendicular thereto.

9. The apparatus according to claim 1, wherein the nozzles are fixed in a predetermined position by means of a fixing mechanism made in the form of a gimbal or ball suspension.

10. The apparatus according to claim 1, wherein the nozzles of the heat module comprise catalytic and/or multiple-zone dissectors for effecting uniform heating of snow mass.

11. The apparatus according to claim 1, wherein the nozzles are made in the form of burners.

12. The apparatus according to claim 1, wherein the heat module comprises a protective heat screen disposed within the lower portion of the heat module to protect the upper vegetation layer against direct exposure to heat when operating where the snow layers are of small thickness.

13. The apparatus according to claim 1, wherein the heat module further comprises a means for ripping and mixing the snow mass.

14. The apparatus according to claim 1, which comprises a frame, whose front part is pivotally connected to a front sliding support, and the rear part thereof is connected to a rear sliding support, wherein the power generator, a pumping station, the heat unit and also a means for static compaction and the means for dynamic compaction are disposed on the frame.

15. The apparatus according to claim 1, which comprises a mechanism for following up the relief of the surface being treated in order to follow continuously the natural and artificial irregularities of the relief and maintain a constant working gap between the surface being treated and the heat unit by way of adjusting the height to which the heat module(s) is (are) lifted up and/or lowered down.

16. The apparatus according to claim 15, wherein the mechanism for following up the relief of the surface is made in the form of a three-dimensional parallelepiped consisting of at least four rocking levers whose upper ends are attached to the frame of the apparatus, and the lower ends thereof, to the heat module by means of articulated joints.

17. An apparatus for making compacted snow pavements, the apparatus comprising:

sliding supports, a power generator, a heat unit having a working zone and provided with a means for supplying heat to snow mass through the working zone, and a means for dynamic compaction, wherein the heat unit is made in the form of at least one separate heat module, the means for supplying heat being made in the form of at least one nozzle aimed at the working zone and rotatably mounted so that the direction of heat flow can be changed relative to vertical and horizontal axes and the nozzle can be fixed in a predetermined position.

18. The apparatus according to claim 17, which comprises a means for static compaction that is disposed in front of the means for dynamic compaction in the direction of the apparatus travel.

19. The apparatus according to claim 17, wherein the means for supplying heat is made so as to be capable of varying intensity of supplying the heat flow to the working zone.

20. The apparatus according to claim 17, wherein the heat module comprises a heat-insulation casing defining the working zone.

21. The apparatus according to claim 20, wherein the casing has side surface(s) and upper surface.

22. The apparatus according to claim 20, wherein at least the casing surface adjacent to the surface being treated is made so that it is open.

23. The apparatus according to claim 17, wherein the nozzle is pivotally mounted in the vicinity of and/or on the upper surface of the casing.

24. The apparatus according to claim 17, wherein the nozzle is arranged at an angle of 15° to 165° relative to the longitudinal axis and transverse axis of the apparatus.

25. The apparatus according to claim 17, wherein the nozzle is fixed in a predetermined position by means of a fixing mechanism made in the form of a gimbal or ball suspension.

26. The apparatus according to claim 17, wherein the nozzle of the heat module comprises at least one catalytic and/or multiple-zone dissector for effecting uniform heating of snow mass.

27. The apparatus according to claim 17, wherein the nozzle is made in the form of a burner.

28. The apparatus according to claim 17, wherein the heat module comprises a protective heat screen disposed within the lower portion of the heat module to protect the upper vegetation layer against direct exposure to heat when operating where the snow layers are of small thickness.

29. The apparatus according to claim 17, wherein the heat module further comprises a means for ripping and mixing the snow mass.

30. The apparatus according to claim 17, which comprises a frame, whose front part is pivotally connected to a front sliding support, and the rear part thereof is connected to a rear sliding support, wherein the power generator, pumping station, heat unit and also the systems for static and dynamic compaction are disposed on the frame.

31. The apparatus according to claim 17, which comprises a mechanism for following up the relief of the surface being treated in order to follow continuously the natural and artificial irregularities of the relief and maintain a constant working gap between the surface being treated and the heat unit by way of adjusting the height to which the heat module(s) is (are) lifted up and/or lowered down.

32. The apparatus according to claim 17, wherein the mechanism for following up the relief of the surface is made in the form of a three-dimensional parallelepiped consisting of at least four rocking levers whose upper ends are attached to the frame of the apparatus, and the lower ends thereof, to the heat module by means of articulated joints.

33. An apparatus for making compacted snow pavements, the apparatus comprising:

a frame, whereon mounted are sliding supports, a power generator, a pumping station, a system for dynamic compaction, and a heat unit having a working zone and provided with a means for supplying heat to snow mass through the working zone, wherein a system for static compaction is provided which comprises a means for adjusting the force applied to the surface being treated within the range of static loads of 0.5 to 40 t, the means for adjusting the force applied to the surface being treated is made in the form of a body/bodies disposed movably on the frame, wherein the system for static compaction comprises a hopper for abrasive material, whereto ballast weights can be fastened, whereas the system for dynamic compaction is made so as to be capable of adjusting the frequencies of dynamic influence within the range of 0.2 to 1000 Hz.

34. The apparatus according to claim 33, wherein at least one component of the apparatus is used as the movable body, in order to vary the profile of static loads on the surface being treated.

35. The apparatus according to claim 33, wherein the hopper for abrasive material comprises a means for uniform distribution of abrasive material in various fractions over the pavement width for dosing thereof and introducing it in between the systems for static and dynamics compaction into the surface being treated.

36. The apparatus according to claim 33, wherein the system for static compaction includes a rear sliding support.

37. The apparatus according to claim 33, wherein the force applied to the surface being treated is within the range of dynamic frequencies or 25 to 450 Hz.

38. The apparatus according to claim 33, wherein the system for dynamic compaction can comprise a vibrating compactor made so as to be capable of forming a corrugated surface on the profile of the surface being treated.

39. The apparatus according to claim 38, wherein the vibrating compactor is made in the form of a vibrating plate and/or a vibrating roller.

40. The apparatus according to claim 33, wherein the frame is made so that it is tubular, and it can thus perform the function of a fuel tank for supplying fuel to the power units of the apparatus.

41. The apparatus according to claim 33, which further comprises an operator's cab.

42. The apparatus according to claim 33, wherein the system for dynamic compaction can further be provided with a hydraulic and/or electrical drive.

43. The apparatus according to claim 33, wherein front support is made in the form of pivotable skies or a pivotable platform for a semitrailer prime mover.

44. The apparatus according to claim 34, wherein the at least one component of the apparatus used as the movable body is selected from among the power generator, the pumping station and/or the heat unit.

45. The apparatus according to claim 33, wherein the abrasive material is selected from among sand, granite aggregate or absorbent for combustible and lubricating materials.

46. The apparatus according to claim 33, wherein the hopper for abrasive material further comprises ballast weights fastened thereto.

47. An apparatus for making compacted snow pavements, the apparatus comprising:

a front pivotable sliding support, a rear sliding support positioned perpendicularly to a direction of movement of the apparatus, a power generator, a heat unit having a working zone and provided with a means for supplying heat to snow mass through the working zone, and a means for dynamic compaction, wherein the heat unit is made in the form of at least one separate heat module, and the means for supplying heat comprises at least one nozzle pivotally mounted so that the at least one nozzle can swing and its angular position can be fixed and the means for supplying heat is mounted so as to be capable of adjusting intensity of the heat flow while fixing the direction in which it is supplied to the working zone.

48. The apparatus according to claim 47, which comprises a means for static compaction that is disposed in front of the means for dynamic compaction in the direction of the apparatus travel.

49. The apparatus according to claim 47, wherein the heat module comprises a heat-insulation casing defining the working zone.

50. The apparatus according to claim 49, wherein the casing has side surface(s), an upper surface, and a lower surface that is adjacent to the surface being treated.

51. The apparatus according to claims 49, wherein at least the casing surface adjacent to the surface being treated is made so that it is open.

52. The apparatus according to claim 47, wherein the means for supplying heat is made in the form of at least one nozzle pivotally mounted in the vicinity of the upper surface of the casing so that it can swing and its angular position can be fixed.

53. The apparatus according to claim 47, wherein the means for supplying heat is made in the form of at least one nozzle pivotally mounted in the vicinity of the side surface of the casing so that it can swing and its angular position can be fixed.

54. The apparatus according to claim 47, wherein the means for supplying heat is made in the form of at least one pair of nozzles pivotally mounted so that they face one another in the vicinity of the side surface of the casing so that they can swing and their angular position can be fixed.

55. The apparatus according to claim 47, which comprises a mechanism for following up the relief of the surface being treated in order to follow continuously the natural and artificial irregularities of the relief and maintain a constant working gap between the surface being treated and the heat unit by way of adjusting the height to which the heat module(s) is (are) lifted up and/or lowered down.

56. The apparatus according to claim 55, wherein the mechanism for following up the relief of the surface is made in the form of a three-dimensional parallelepiped consisting of at least four rocking levers whose upper ends are attached to the frame of the apparatus, and the lower ends thereof, to the heat module by means of articulated joints.

57. The apparatus according to claim 47, wherein the heat module further comprises a means for ripping and mixing the snow mass.

58. The apparatus according to claim 52, wherein the one or each nozzle is mounted so that it can be fixed in a predetermined angular position by means of a fixing mechanism.

59. The apparatus according to claim 58, wherein the fixing mechanism is made in the form of a gimbal or ball suspension.

60. An apparatus for making compacted snow pavements, the apparatus comprising:

a frame, a front pivotable sliding support attached pivotally to the frame, and a rear sliding support attached to the frame, a power generator, a heat unit having a working zone and provided with a means for supplying heat to snow mass through the working zone, and a means for dynamic compaction, a mechanism for following up the relief of the surface being treated in order to follow continuously the natural and artificial irregularities of the relief and maintain a constant working gap between the surface being treated and the heat unit by way of adjusting the height to which the heat module(s) is (are) lifted up and/or lowered down, the mechanism for following up the relief of the surface comprising a three-dimensional parallelepiped consisting of at least four rocking levers whose upper ends are attached to the frame of the apparatus, and the lower ends thereof, to the heat module by means of articulated joints, wherein a system for static compaction is provided that is disposed behind the means for dynamic compaction in the direction of the apparatus travel and comprises a means for adjusting the force applied to the surface being treated and made in the form of a body/bodies disposed movably on the frame.

61. The apparatus according to claim 60, wherein used as the movable body/bodies, are the hopper, the power generator, the heat unit and/or other components of the apparatus.

62. A method of making a compacted snow pavement, the method comprising the steps of:

heating snow mass in a heat unit until the mass reaches a moistened condition, and compacting the moistened snow mass by means of a compaction system, wherein during heating the snow mass in the heat unit, the exposure temperature is adjusted within the range of 110° C. to 1600° C. in inverse proportion to variations in the ambient temperature and in direct proportion to a travel speed of the apparatus by varying a directional angle and intensity of supplying heat flow to the snow mass, and the moistened snow is compacted in two steps, in which: at the step of static compaction, the load applied to the snow mass thus treated is adjusted by varying the force on a rear support, whereupon dynamic vibrating compaction is effected so that the frequency of dynamic influence can be adjusted within the range of 0.2 to 1000 Hz;

wherein varying the directional angle and intensity of supplying heat flow to the snow mass comprises rotating at least two nozzles aimed at the working zone.

63. The method according to claim 62, wherein heating of the snow mass is effected simultaneously with mixing thereof until an essentially uniform mixture is obtained.

64. The method according to claim 62, wherein, at the step of static compaction, use is made of the load ranging from 0.5 to 40 t.

65. The method according to claim 62, wherein, at the step of dynamic vibrating compaction, use is made of the frequency ranging from 25 to 450 Hz.

66. The method according to claim 62, wherein the dynamic vibrating compaction is carried out so that a corrugated surface is simultaneously formed on the profile of the road.

67. The method according to claim 62, wherein protective heat screens are mounted within the lower portions of the heat modules when operating where the snow layers are of small thickness.

68. The method according to claim 62, wherein, after the step of static compaction, an abrasive material, including also an absorbent for combustible and lubricating materials, can be further applied uniformly to the statically compacted surface of the pavement.

* * * * *